US008833110B2

(12) United States Patent
Takahashi et al.

(10) Patent No.: US 8,833,110 B2
(45) Date of Patent: Sep. 16, 2014

(54) WASHING MACHINE

(75) Inventors: Taketo Takahashi, Osaka (JP); Shinichiro Kobayashi, Osaka (JP)

(73) Assignee: Panasonic Corporation, Osaka (JP)

( * ) Notice: Subject to any disclaimer, the term of this patent is extended or adjusted under 35 U.S.C. 154(b) by 3 days.

(21) Appl. No.: 13/696,538

(22) PCT Filed: Feb. 22, 2012

(86) PCT No.: PCT/JP2012/001203
§ 371 (c)(1),
(2), (4) Date: Nov. 6, 2012

(87) PCT Pub. No.: WO2012/114740
PCT Pub. Date: Aug. 30, 2012

(65) Prior Publication Data

US 2013/0055768 A1 Mar. 7, 2013

(30) Foreign Application Priority Data

Feb. 23, 2011 (JP) ..... 2011-036737

(51) Int. Cl.
*D06F 35/00* (2006.01)
*D06F 39/08* (2006.01)

(52) U.S. Cl.
CPC ..... *D06F 39/081* (2013.01)
USPC ..... 68/13 R; 68/3 R; 68/139; 68/208; 68/12.01; 340/605; 340/604; 340/500

(58) Field of Classification Search
CPC ..... D06F 39/081; D06F 39/12; D06F 39/125; D06F 58/203
USPC ..... 8/158, 159; 68/12.01, 12.27, 208; 340/605, 500, 604; 134/56 D, 57 D, 134/58 D; 137/312, 386, 387
See application file for complete search history.

(56) References Cited

U.S. PATENT DOCUMENTS 3,200,388 A 8/1965 Uhlig
5,272,467 A 12/1993 Krauleidies
(Continued)

FOREIGN PATENT DOCUMENTS

DE 2820470 A1 1/1979
DE 19528322 A1 2/1997
(Continued)

OTHER PUBLICATIONS

Extended European Search Report for European Application No. 12749653.7, dated Jan. 24, 2013, 5 pages.
(Continued)

*Primary Examiner* — Michael Barr
*Assistant Examiner* — Thomas Bucci
(74) *Attorney, Agent, or Firm* — Brinks Gilson & Lione

(57) ABSTRACT

A washing machine includes a washing machine housing having electrical conducting properties and having an earth connection portion, a leaked water tub having electrical insulating properties and installed in a bottom part of the washing machine housing for accumulating leaked water, an electrode for detecting presence or absence of the leaked water in the leaked water tub, a leaked water detection circuit connected to the electrode, the leaked water detection circuit having an electrical insulating function, a retaining member having electrical insulating properties and retaining the electrode, and an attachment member having electrical conducting properties and attaching the electrode to the washing machine housing via the retaining member. The attachment member is electrically connected to the washing machine housing. In the leaked water tub, a lowest end of the attachment member is positioned on the lower side of a lowest end of the electrode. Thereby, a safe and inexpensive washing machine is realized.

2 Claims, 4 Drawing Sheets

(56) References Cited

U.S. PATENT DOCUMENTS

| | | | | |
|---|---|---|---|---|
| 5,680,049 | A * | 10/1997 | Gissler et al. | 324/368 |
| 7,926,138 | B2 * | 4/2011 | Lee | 8/158 |
| 2009/0272003 | A1 * | 11/2009 | Dalton et al. | 34/329 |

FOREIGN PATENT DOCUMENTS

| | | | |
|---|---|---|---|
| JP | 63-154196 | A | 6/1988 |
| JP | 10-160547 | A | 6/1998 |

OTHER PUBLICATIONS

International Search Report for International Application No. PCT/JP2012/001203, dated May 1, 2012, 1 page.

* cited by examiner

WASHING MACHINE

This application is a 371 application of PCT/JP2012/001203 having an international filing date of Feb. 22, 2012, which claims priority to JP2011-036737 filed Feb. 23, 2011, the entire contents of which are incorporated herein by reference.

TECHNICAL FIELD

The present invention relates to a washing machine having high safety.

BACKGROUND ART

For example, a washing machine described in Patent Document 1 has a dirt sensor such as a conductivity sensor for detecting a state of a washing liquid in a water tank, and executes control of a washing step based on a detection result of the state of the washing liquid such as dirt.

FIG. 4 is a vertically sectional view of the washing machine described in Patent Document 1.

As shown in FIG. 4, a transparency detection portion 63 for detecting a transparency of the washing liquid is provided in a drainage port of a water tank 62 accommodating a washing tank 61 in which an agitation blade 67 is arranged on a bottom. The transparency of the washing liquid detected by the transparency detection portion 63 is converted into a voltage signal by a first control portion 63*a* configured by an input unit, an output unit, and an arithmetic control unit. The first control portion 63*a* drives a motor 66 for driving the agitation blade 67 via a motor drive portion 65 based on this voltage signal.

Between the washing tank 61 and the water tank 62, a conductivity detection portion 64 for detecting conductivity of the washing liquid is provided. Based on the conductivity of the washing liquid detected by the conductivity detection portion 64, a second control portion 64*a* formed by an input unit, an output unit, and an arithmetic control unit determines a type of detergent. The second control portion 64*a* drives the motor 66 via the motor drive portion 65 based on the determined type of detergent.

The second control portion 64*a* extends a washing time in correspondence with the determined type of detergent.

Patent Document 1: Japanese Unexamined Patent Publication No. 63-154196

SUMMARY OF THE INVENTION

Problems to be Solved by the Invention

As a detection portion (sensor) for detecting the state of the washing liquid like the transparency detection portion and the conductivity detection portion provided in the washing machine described in Patent Document 1, there is a detection portion (sensor) for applying an electric current to the washing liquid at the time of detection. For example, in order to detect leaked water due to deterioration of a seal member for sealing a joint of the water tank and breakage of a water supply passage or a drainage passage, an electrode of a leaked water detection portion for detecting the leaked water is provided in a bottom part of the washing machine. In a case where the leaked water overflows to an exterior of the washing machine, there is a possibility that a user contacts the leaked water electrically connected to the electrode so as to get an electric shock. As a countermeasure, it is thought that reinforced insulation is provided between the electrode of the leaked water detection portion and the user. However, the reinforced insulation requires high cost.

Thus, an object of the present invention is to provide a safe and inexpensive washing machine not requiring expensive reinforced insulation.

Means for Solving the Problems

In order to achieve the above object, the present invention is formed as follows.

According to an aspect of the invention, there is provided a washing machine, comprising: a washing machine housing having electrical conducting properties and having an earth connection portion; a leaked water tub having electrical insulating properties and installed in a bottom part of the washing machine housing for accumulating leaked water; an electrode for detecting presence or absence of the leaked water in the leaked water tub; a leaked water detection circuit connected to the electrode, the leaked water detection circuit having an electrical insulating function; a retaining member having electrical insulating properties and retaining the electrode; and an attachment member having electrical conducting properties and attaching the electrode to the washing machine housing via the retaining member, wherein the attachment member is electrically connected to the washing machine housing, and in the leaked water tub, a lowest end of the attachment member is positioned on a lower side of a lowest end of the electrode.

Effects of the Invention

According to the present invention, the safe and inexpensive washing machine can be realized by a simple configuration without requiring expensive reinforced insulation.

BRIEF DESCRIPTION OF THE DRAWINGS

These modes and characteristics of the present invention will be clarified from the following description relating to a preferred embodiment of the accompanying drawings. In the drawings.

DETAILED DESCRIPTION OF THE PREFERRED EMBODIMENT

The present invention is a washing machine including a washing machine housing having electrical conducting properties and having an earth connection portion, a leaked water tub having electrical insulating properties and installed in a bottom part of the washing machine housing for accumulating leaked water, an electrode for detecting presence or absence of the leaked water in the leaked water tub, a leaked water detection circuit connected to the electrode, the leaked water detection circuit having an electrical insulating function, a retaining member having electrical insulating properties and retaining the electrode, and an attachment member having electrical conducting properties and attaching the electrode to the washing machine housing via the retaining member, wherein the attachment member is electrically connected to the washing machine housing, and in the leaked water tub, a lowest end of the attachment member is positioned on a lower side of a lowest end of the electrode.

According to the present invention, the leaked water in the leaked water tub is brought into contact with the lowest end of the attachment member before being brought into contact with the electrode. The attachment member is electrically connected to the washing machine housing grounded by the earth connection portion. Thereby, even when contacting with the leaked water, a user does not get an electric shock. As a result, a safe and inexpensive washing machine is realized.

The leaked water detection circuit and the electrode may be electrically separated by a transformer. Thereby, safety of the washing machine is further improved.

Hereinafter, an embodiment of the present invention will be described with reference to the drawings. It should be noted that although the present invention will be described taking a drum washing machine as an example, the present invention is not limited to the drum washing machine. The present invention is applicable to an upright type washing machine.

Figure 1:
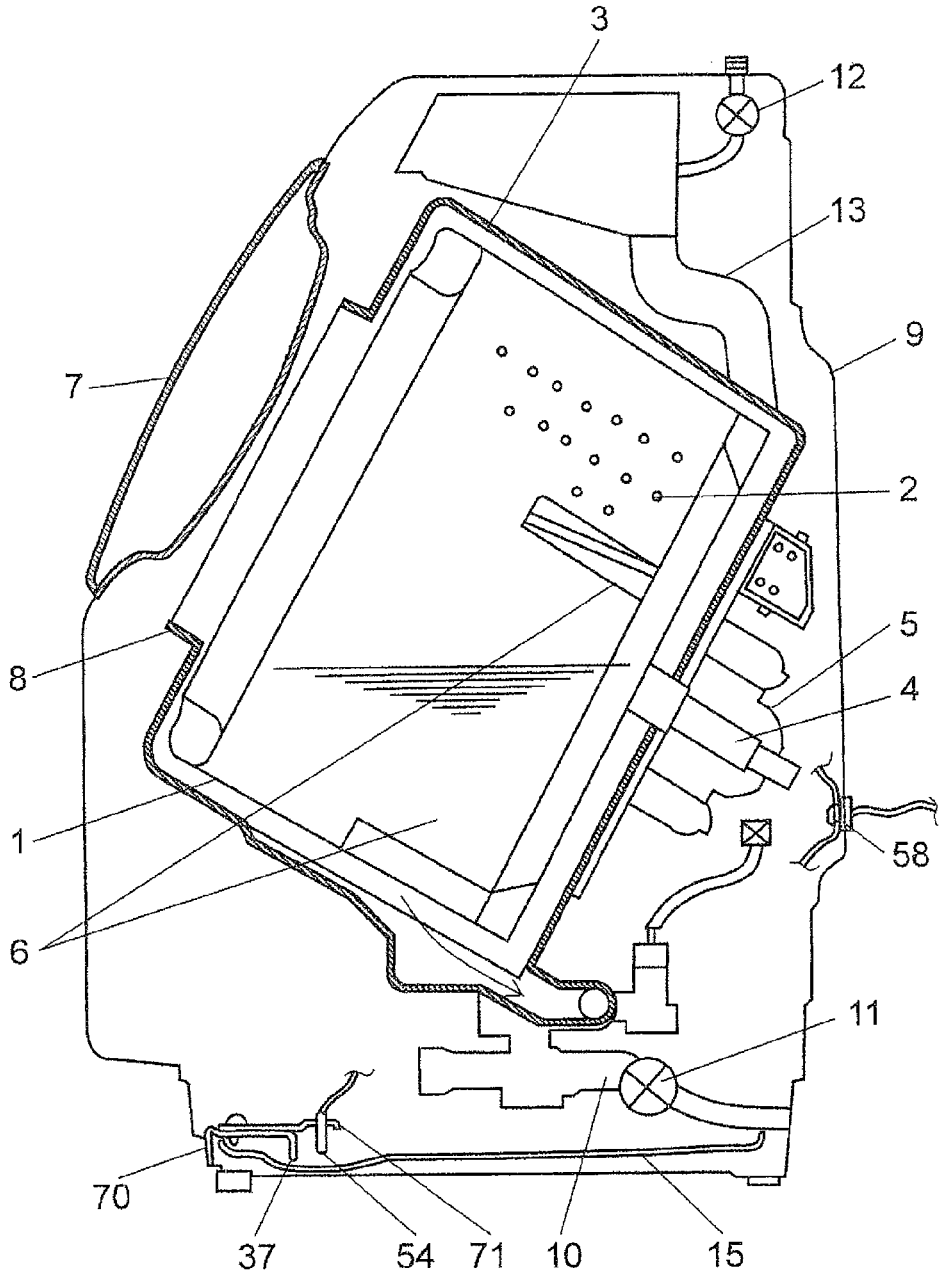
FIG. 1 is a vertically sectional view of a washing machine in an embodiment of the present invention.

FIG. 1 is a vertically sectional view of the washing machine in the embodiment of the present invention.

As shown in FIG. 1, a cylindrical rotary drum 1 with a bottom has a plurality of water passage holes 2 in an outer peripheral part. The rotary drum 1 is rotatably arranged in a water tank 3 so that a rotation center line thereof is inclined downward from a front surface of the washing machine toward a back surface. A rotation shaft (rotation center axis) 4 extending in the substantially inclining direction is provided in a rotation center part of the rotary drum 1. A motor 5 attached to a back part of the water tank 3 is coupled to this rotation shaft 4. The rotary drum 1 is driven and rotated in the forward direction or in the reverse direction by the motor 5. Several protuberances 6 are provided on an inner wall surface of the rotary drum 1.

A lid body 7 openably and closably covers an opening portion formed on an upward inclined surface of a washing machine housing 9 which is positioned on the front surface side of the water tank 3. By opening this lid body 7, a laundry can be brought into the rotary drum 1 via a laundry outlet/inlet 8.

The water tank 3 is oscillatably elastically supported on the washing machine housing 9 via an anti-vibration damper (not shown). In order to drain a washing liquid, one end of a drainage member 10 is connected to a lower part of the water tank 3, and the other end of the drainage member 10 is connected to a drainage valve 11. A water supply valve 12 supplies water into the water tank 3 via a water supply passage 13.

A leaked water tub 15 having electrical insulating properties, for receiving and accumulating the washing liquid (leaked water), which leaked due to breakage of the water tank 3, the water supply passage 13, or the drainage valve 11, is provided in a bottom part of the washing machine housing 9. The leaked water tub 15 is manufactured from electrical insulating resin for example. In the leaked water tub 15, an electrode (electrode sensor) 54 for detecting presence or absence of the leaked water in the leaked water tub 15 is arranged.

The washing machine housing 9 is provided with a back surface having electrical conducting properties and having an earth connection portion 58 for grounding. For example, the back surface of the washing machine housing 9 is manufactured from metal. A base frame 70 of the washing machine housing 9 also has electrical conducting properties and is manufactured from metal for example. The back surface of the washing machine housing 9 and the base frame 70 are in contact with each other (that is, electrically connected to each other).

The electrode 54 is retained by a retaining member 71 having electrical insulating properties and manufactured from resin. The electrode 54 is retained by the retaining member 71 in a state that a front end is directed downward, that is, the front end is directed toward a bottom of the leaked water tub 15.

The insulating retaining member 71 is attached to an attachment member 37, which having electrical conducting properties and manufactured from metal, by using a screw. The conductive attachment member 37 is attached (that is, electrically connected) to the washing machine housing 9 (base frame 70). The leaked water accumulated in the leaked water tub 15 is detected by contact with the electrode 54.

The conductive attachment member 37 extends downward in the leaked water tub 15, and a lowest end thereof is positioned on the lower side of a front end (lowest end) of the electrode 54. Therefore, before the leaked water is brought into contact with the front end of the electrode 54, the leaked water is brought into contact with the lowest end of the attachment member 37. The attachment member 37 is electrically connected to the back surface of the washing machine housing 9 grounded via the earth connection portion 58. Thus, even when contacting with the leaked water overflowing from the leaked water tub 15 (that is, the leaked water electrically connected to the electrode 54), a user does not get an electric shock. As a result, safety of the user is ensured.

It should be noted that the rotary drum 1 of the present embodiment is arranged so that the rotation center line thereof is inclined downward from the front surface of the washing machine toward the back surface. Instead of this, the rotary drum may be arranged in the washing machine so that the rotation center line direction of the rotary drum 1 matches with the substantially horizontal direction or the substantially vertical direction.

Figure 2:
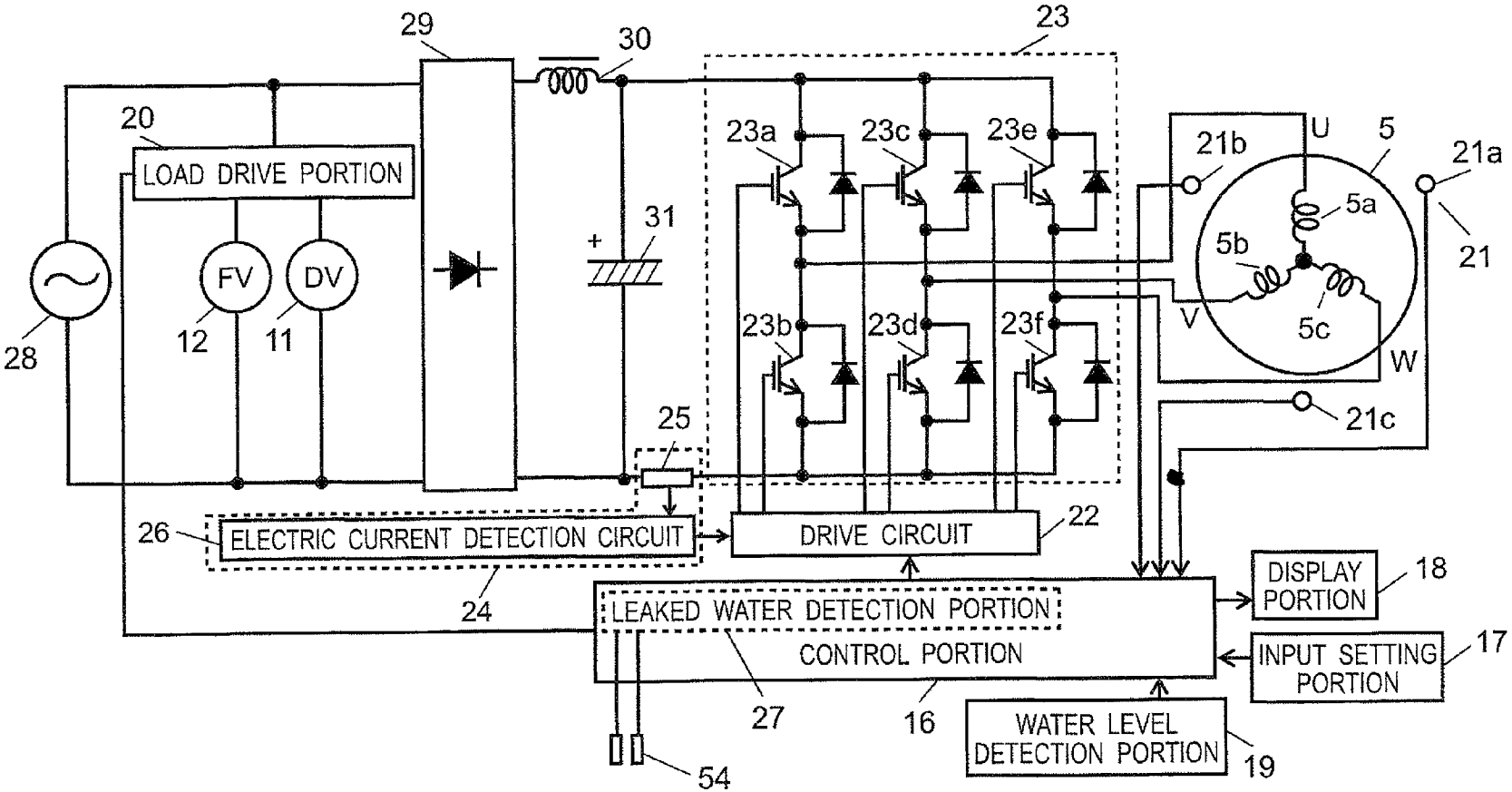
FIG. 2 is a circuit diagram of the washing machine of FIG. 1.

FIG. 2 is a circuit diagram of the washing machine in the embodiment of the present invention.

As shown in FIG. 2, the washing machine has a rectifier 29 for converting AC power from an AC power source 28 into DC power, and a smoothing circuit configured by a choke coil 30 and a smoothing capacitor 31 for smoothing the DC power. A control portion 16 of the washing machine drives the motor 5 via an inverter 23 with the smoothed DC power and controls actions of the water supply valve 12, the drainage valve 11, and the like. Thereby, the control portion 16 controls a washing step, a rinsing step, and a water removal step.

The control portion 16 displays information inputted by the user via an input setting portion 17 for setting an operation course and the like on a display portion 18 so as to notify the user. When an operation is started by the user via the input setting portion 17, the control portion 16 controls the actions of the drainage valve 11, the water supply valve 12, and the like via a load drive portion 20 based on a signal from a water level detection portion 19 for detecting a water level of the washing liquid in the water tub 3, a signal from a leaked water detection portion 27 for detecting the leaked water via the electrode 54, or the like, so as to execute a washing operation. It should be noted that in a case where an abnormality is detected, the control portion 16 notifies of the abnormality.

Further, the control portion 16 controls the inverter 23 via a drive circuit 22 based on a detection result of position detection portions 21 for detecting a position of a rotor of the motor 5, so as to control rotation of the motor 5.

The motor 5 is a DC brushless motor formed by a stator having three phase windings, and the rotor in which two polar permanent magnets are arranged on a ring although not shown. A first winding 5*a*, a second winding 5*b*, and a third winding 5*c* forming the three phase windings of the stator are wound around an iron core provided with a slot.

The inverter 23 is formed by a plurality of switching elements including parallel circuits of power transistors (IGBT) and reverse conducting diodes. Specifically, the inverter 23 has a series circuit of a first switching element 23*a* and a second switching element 23*b*, a series circuit of a third switching element 23*c* and a fourth switching element 23*d*, and a series circuit of a fifth switching element 23*e* and a sixth switching element 23*f*. The three series circuits are connected in parallel.

Both ends of the series circuit of the switching elements are input terminals connected to a DC power source, and a connection point of the two switching elements forming the series circuit of the switching elements is an output terminal. The output terminals are connected to a U terminal, a V terminal, and a W terminal of the three phase windings. By selectively turning on/off the two switching elements forming the series circuit of the switching elements, the U terminal, the V terminal, and the W terminal are selectively brought into a positive voltage application state, a zero voltage application state, and an open voltage application state.

Turning on/off of the switching elements is controlled by the control portion 16 based on the detection result of the three position detection portions 21*a*, 21*b*, 21*c* including Hall elements for detecting the position of the rotor. The position detection portions 21*a*, 21*b*, 21*c* are arranged in the stator at a 120-degree interval of an electric angle with facing the permanent magnets of the rotor.

While the rotor makes one rotation, the three position detection portions 21*a*, 21*b*, 21*c* output pulses at a 120-degree internal of an electrical angle. The control portion 16 detects a timing when a state of an output signal from any of the three position detection portions 21*a*, 21*b*, 21*c* is changed. Based on the signal of the position detection portion 21*a*, 21*b*, 21*c* whose state is changed, the control portion 16 switches on/off the switching elements 23*a* to 23*f* and selectively brings the U terminal, the V terminal, and the W terminal into the positive voltage application state, the zero voltage application state, and the open voltage application state, so as to selectively apply electric power to the first winding 5*a*, the second winding 5*b*, and the third winding 5*c* of the stator. The rotor is rotated by a magnetic field generated by the winding to which the electric power is applied.

The switching elements 23*a*, 23*c*, 23*e* are respectively pulse-width modulation (PWM) controlled, for example, controlled by a PWM signal of repetition frequency of 10 kHz. The control portion 16 controls a DUTY ratio of the PWM signal so as to control the rotation number of the rotor. Every time when the state of the output signal from any of the three position detection portions 21*a*, 21*b*, 21*c* is changed, the control portion 16 calculates a cycle of the output signal, and calculates the rotation number of the rotor from the calculated cycle. The control portion 16 PWM controls the switching elements 23*a*, 23*c*, 23*e* so that the calculated rotation number of the rotor becomes the set rotation number.

A torque detection portion 24 is formed by a resistance 25 connected to the input terminals on one side of the inverter 23, and an electric current detection circuit 26 connected to this resistance 25. The torque detection portion 24 detects an input current of the inverter 23, coverts the detected input current into a voltage signal, and outputs the voltage signal to the control portion 16. The control portion 16 A/D converts the voltage signal inputted from the torque detection portion 24, and computes the digital signal after conversion. In a case where the motor 5 is a DC brushless motor, torque of the motor 5 is substantially proportional to the input current of the inverter 23. Therefore, by detecting an input current value of the inverter 23 by the electric current detection circuit 26 connected to the resistance 25, the torque of the motor 5 can be detected.

Figure 3:
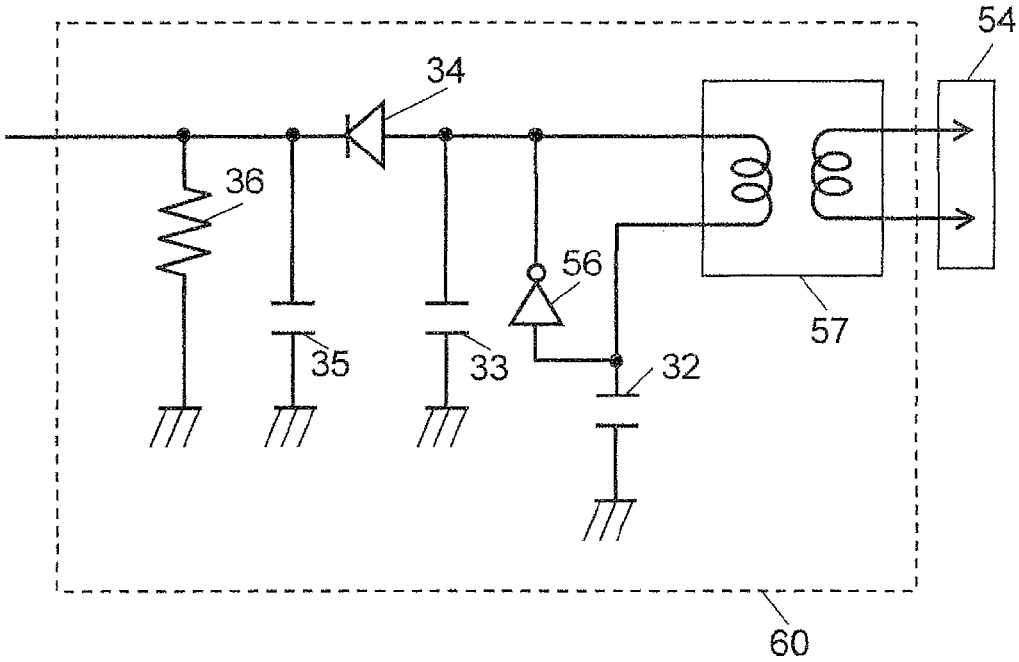
FIG. 3 is a diagram of a leaked water detection circuit of the washing machine of FIG. 1.
Figure 4:
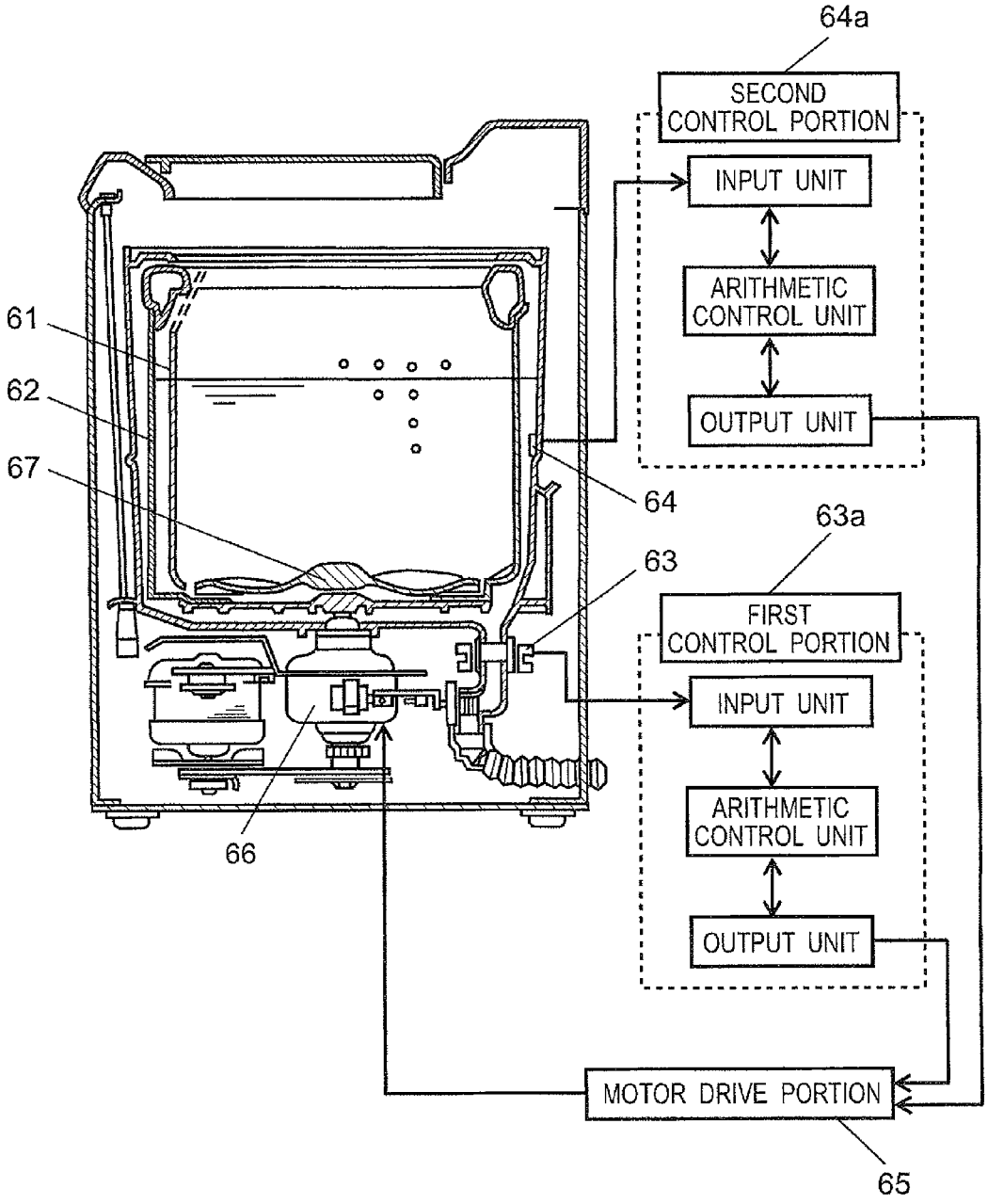
FIG.4 Prior Art
FIG. 4 is a vertically sectional view of a conventional washing machine.

FIG. 3 shows a leaked water detection circuit 60 in the leaked water detection portion 27.

As shown in FIG. 3, the leaked water detection circuit 60 is electrically separated from the electrode 54 by a transformer 57 so as to have a basic insulation function. By this transformer 57, an electric shock of the user due to the leaked water electrically connected to the electrode 54 is further prevented. In the leaked water detection circuit 60, the transformer 57, an inverter 56, and capacitors 32, 33 form a parallel resonance circuit.

A diode 34, a capacitor 35, and a resistance 36 smooth a resonance output of the parallel resonance circuit. Based on a resistance value between both ends of the electrode 54, the presence or the absence of the leaked water in the leaked water tub 15 is detected.

As described above, according to the present embodiment, the washing machine can prevent the electric shock of the user due to the leaked water by inexpensive basic insulation without providing expensive reinforced insulation to the leaked water detection portion 27 (leaked water detection circuit 60). As a result, a safe and inexpensive washing machine can be realized.

It should be noted that reinforced insulation or basic insulation is generally defined by the Electrical Appliance and Material Safety Law and IEC (International Electrotechnical Commission).

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2011-036737 filed on Feb. 23, 2011 including specification, drawings, and claims is incorporated herein by reference in its entirety.

INDUSTRIAL APPLICABILITY

As described above, the present invention can realize an inexpensive and safe washing machine by basic insulation without requiring reinforced insulation. Therefore, the present invention can be applied to various types of washing machines.

The invention claimed is:

1. A washing machine, comprising:

a washing machine housing having electrical conducting properties and having an earth connection portion;

a leaked water tub having electrical insulating properties and installed in a bottom part of the washing machine housing for accumulating leaked water;

an electrode extending into the leaked water tub, the electrode configured to detect the presence or absence of the leaked water in the leaked water tub and to detect the presence of the leaked water in the leaked water tub by contacting with the leaked water in the leaked water tub;

a leaked water detection circuit connected to the electrode, the leaked water detection circuit having an electrical insulating function;

a retaining member having electrical insulating properties and retaining the electrode; and an attachment member having electrical conducting properties and attaching the electrode to the washing machine housing via the retaining member, wherein the attachment member is attached to the washing machine housing to be electrically connected to the washing machine housing, and in the leaked water tub, the retaining member positions the electrode such that a lowest end of the attachment member is closer to a bottom surface of the leaked water tub than a lowest end of the electrode.

2. The washing machine according to claim 1, wherein the leaked water detection circuit is electrically separated from the electrode by a transformer so as to have a basic insulation function.

* * * * *